US012564242B2

(12) United States Patent
DiLorenzo et al.

(10) Patent No.: US 12,564,242 B2
(45) Date of Patent: Mar. 3, 2026

(54) TRAINING SHOE

(71) Applicant: TYR Sport, Inc., Farmingdale, NY (US)

(72) Inventors: Matthew Vito DiLorenzo, Farmingdale, NY (US); Yang Wang, Farmingdale, NY (US); Stephanie Lawrence, Farmingdale, NY (US); Corey Berger, Farmingdale, NY (US)

(73) Assignee: TYR SPORT, INC., Farmingdale, NY (US)

( * ) Notice: Subject to any disclaimer, the term of this patent is extended or adjusted under 35 U.S.C. 154(b) by 0 days.

(21) Appl. No.: 17/832,462

(22) Filed: Jun. 3, 2022

(65) Prior Publication Data

US 2023/0389648 A1 Dec. 7, 2023

(51) Int. Cl.
*A43B 13/04* (2006.01)
*A43B 13/12* (2006.01)

(52) U.S. Cl.
CPC ..... *A43B 13/04* (2013.01); *A43B 13/125* (2013.01)

(58) Field of Classification Search
CPC ..... A43B 13/04; A43B 13/125; A43B 13/12; A43B 13/122; A43B 13/127; A43B 13/181; A43B 13/186; A43B 13/185; A43B 5/001; A43B 7/144; A43B 7/1495; A43B 23/227; A43C 1/00; A43C 1/04; A43C 11/00
See application file for complete search history.

(56) References Cited

U.S. PATENT DOCUMENTS

| | | | | |
|---|---|---|---|---|
| D257,186 | S | 10/1980 | Famolare, Jr. | |
| 4,689,898 | A | 9/1987 | Fahey | |
| 4,947,560 | A * | 8/1990 | Fuerst | A43B 23/08 36/114 |
| D327,362 | S | 6/1992 | Hatfield | |
| D329,938 | S | 10/1992 | Lucas | |
| D333,208 | S | 2/1993 | Lucas | |

(Continued)

FOREIGN PATENT DOCUMENTS

| | | |
|---|---|---|
| CN | 307921196 | 3/2023 |
| EA | 009199607-0001 | 12/2022 |
| WO | 2013014433 A1 | 1/2013 |

OTHER PUBLICATIONS

Reebok, Nano X1, webpage <https://www.reebok.com/us/nano_x1>, printed Jul. 26, 2022, 13 pages.

(Continued)

*Primary Examiner* — Haley A Smith
(74) *Attorney, Agent, or Firm* — Stetina Garred Brucker & Newboles

(57) ABSTRACT

A training shoe includes a bottom sole, a midsole disposed above at least a portion of the bottom sole, one or more panels attached to one or both of the midsole and the bottom sole to define an enclosure for a person's foot, and a sidewall comprising a thermoplastic polyurethane (TPU). The sidewall may be disposed on at least a portion of the midsole and at least a portion of the one or more panels so as to define part of an external surface of the training shoe. The sidewall may extend upward past a bottom of the enclosure on either or both of an outer side of the training shoe and an inner side of the training shoe. The sidewall may extend from the outer side of the training shoe to the inner side of the training shoe along a rear of the training shoe.

17 Claims, 6 Drawing Sheets

(56) References Cited

U.S. PATENT DOCUMENTS

| | | | | |
|---|---|---|---|---|
| D334,279 | S | 3/1993 | Teague | |
| D405,241 | S | 2/1999 | Gillespie | |
| D440,385 | S | 4/2001 | Matis | |
| 6,295,741 | B1 | 10/2001 | Kita | |
| D450,918 | S | 11/2001 | Lozano | |
| 6,557,270 | B2 | 5/2003 | Nakano | |
| D515,306 | S | 2/2006 | Andrews-Kramer | |
| D555,891 | S | 11/2007 | Bettencourt | |
| 7,793,435 | B1 | 9/2010 | Ruth | |
| D628,368 | S | 12/2010 | Raysse | |
| D672,123 | S | 12/2012 | Williams, Jr. | |
| D685,166 | S | 7/2013 | Hatfield | |
| D713,626 | S | 9/2014 | Raasch | |
| D746,560 | S | 1/2016 | Verfl | |
| D747,083 | S | 1/2016 | Verfl | |
| D756,620 | S | 5/2016 | Boys | |
| D768,969 | S | 10/2016 | Boys | |
| D770,740 | S | 11/2016 | Teteriatnikov | |
| D885,718 | S | 6/2020 | Roulo | |
| 10,973,279 | B2 * | 4/2021 | Cheney | A43B 3/00 |
| D927,155 | S | 8/2021 | Brammer | |
| D974,716 | S | 1/2023 | Hoang | |
| D992,249 | S | 7/2023 | Head | |
| D1,008,619 | S | 12/2023 | Xanthos | |
| D1,009,427 | S | 1/2024 | Schenone | |
| D1,010,991 | S | 1/2024 | Raleigh | |
| D1,011,717 | S | 1/2024 | Raleigh | |
| D1,015,698 | S | 2/2024 | Dieckhaus | |
| D1,017,206 | S | 3/2024 | Weeks | |
| D1,035,239 | S | 7/2024 | Fang | |
| D1,038,601 | S | 8/2024 | You | |
| D1,041,837 | S | 9/2024 | Han | |
| 2008/0244930 | A1 * | 10/2008 | Rivas | A43B 23/17 36/3 R |
| 2009/0113757 | A1 * | 5/2009 | Banik | A43B 13/188 36/35 R |
| 2009/0260259 | A1 * | 10/2009 | Berend | A43B 7/1435 36/35 B |
| 2011/0088285 | A1 | 4/2011 | Dojan et al. | |
| 2012/0060395 | A1 * | 3/2012 | Blevens | A43B 13/18 36/35 R |
| 2015/0013185 | A1 * | 1/2015 | Elder | A43B 13/122 36/83 |
| 2015/0157088 | A1 * | 6/2015 | Seo | A43B 13/187 36/25 R |
| 2015/0257475 | A1 | 9/2015 | Langvin et al. | |
| 2016/0353833 | A1 * | 12/2016 | Hesterberg | A43C 11/16 |
| 2017/0049186 | A1 * | 2/2017 | Lee | A43B 23/0215 |
| 2017/0231319 | A1 * | 8/2017 | Bohnsack | A43B 13/04 36/92 |
| 2017/0231320 | A1 * | 8/2017 | Nu?Ez | A43B 1/0045 36/93 |
| 2017/0347747 | A1 * | 12/2017 | Groeneweg | A43B 7/20 |
| 2019/0053567 | A1 | 2/2019 | Thomas | |
| 2020/0154822 | A1 | 5/2020 | Kita | |
| 2021/0059351 | A1 * | 3/2021 | Piacentini | A43B 23/088 |
| 2021/0227929 | A1 * | 7/2021 | Ni | A43B 13/37 |
| 2022/0053876 | A1 | 2/2022 | Aubonnet et al. | |

OTHER PUBLICATIONS

Nike, Nike Metcon 7 Training Shoes, webpage <https://www.nike.com/t/metcon-7-training-shoes-016Psg/CZ8281-010>, printed Jul. 26, 2022, 8 pages.

INOV-8, F-Lite G 300, webpage <https://www.inov-8.com/us/f-lite-g-300-mens-cross-training-shoes>, printed Jul. 26, 2022, 9 pages.

Patent Cooperation Treaty, International Search Report and Written Opinion for International Application No. PCT/US2023/024059, Sep. 5, 2023, 9 pages.

Puma Fuse 2.0 Review, First available: Sep. 25, 2022 [online], [visited: Apr. 26, 2024] Available from the internet URL: https://www.youtube.com/watch?v=qgqilpfusUs (Year: 2022).

Reebok Men's Nano X2 Cross Trainer, First available: Feb. 9, 2022 [online], [visited: Apr. 26, 2024] Available from the internet URL: https://www.amazon.com/dp/B092YR3QK9?ref_ = cm_sw_r_cp_ud_dp_DN1 RKC5W4825F079QKR9 (Year: 2022).

TYR CXT-1 Trainer Review, First available: Sep. 13, 2022 [online], [visited: Apr. 26, 2024] Available from the internet URL: https://www.youtube.com/watch?v=69_yMY8y1Yg (Year: 2022).

TYR Women's Trainer, First available: Aug. 14, 2023 [online], [visited: Apr. 26, 2024] Available from the internet URL: https://www.amazon.com/dp/BOC29ZRD57?ref_ = cm_sw_r_cp_ud_dp_9ZPPXGGBH9GSCETBKHV6&th=1 (Year: 2023).

* cited by examiner

FIG. 10
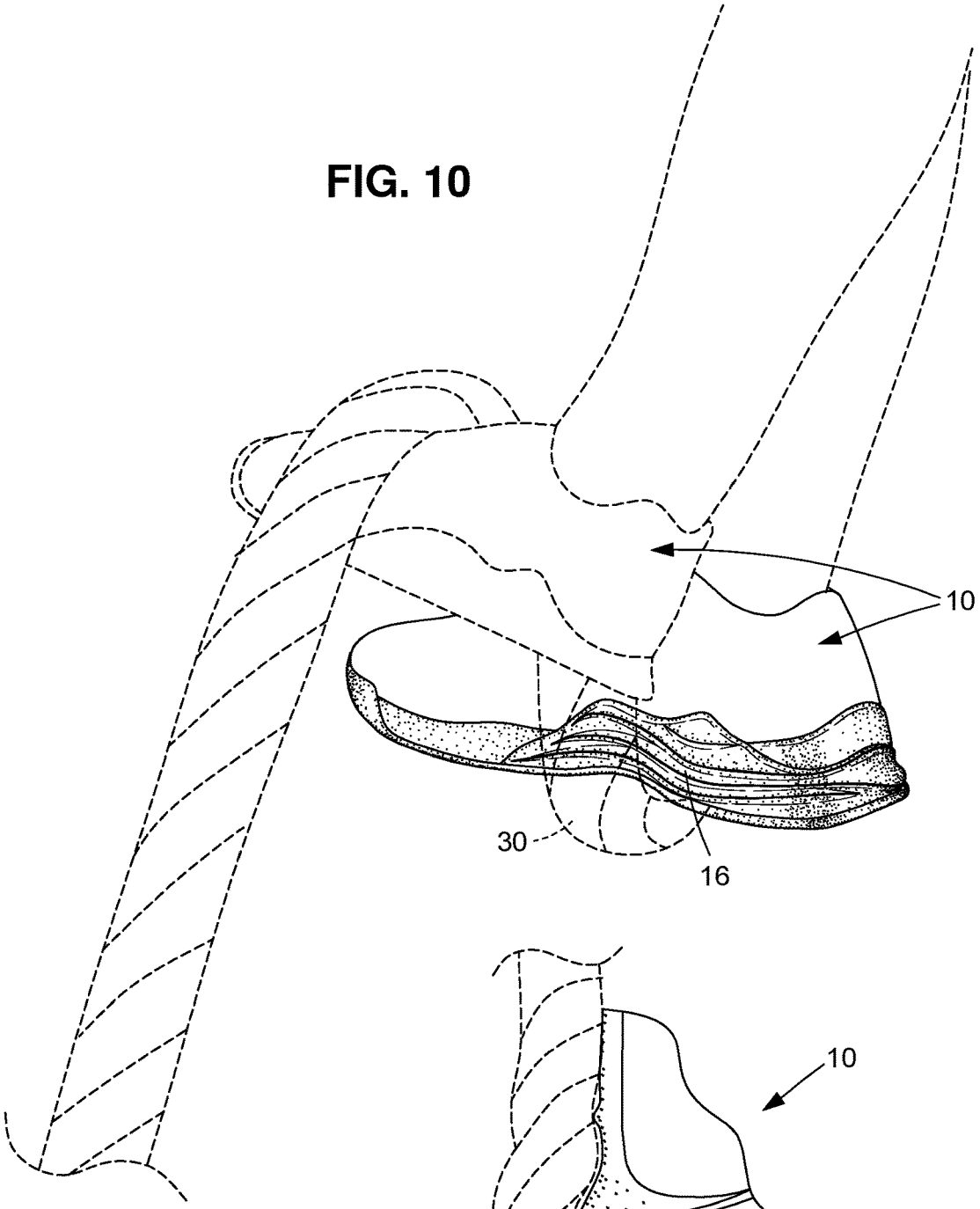
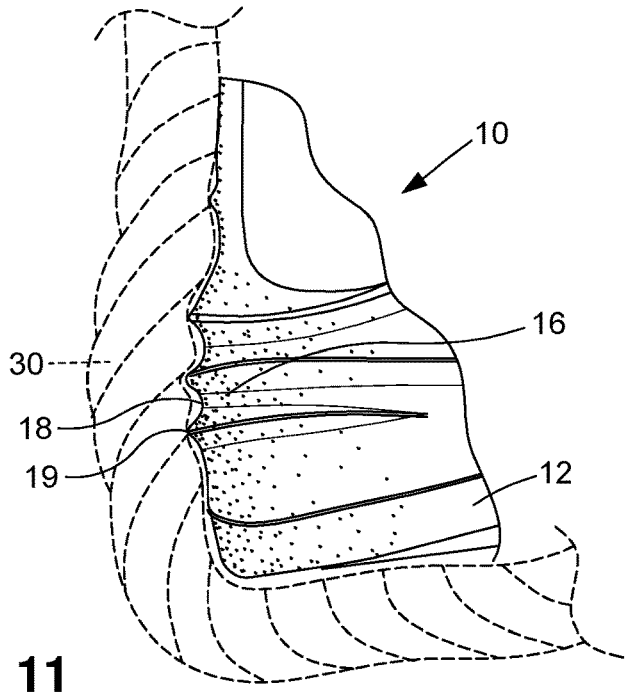
FIG. 11

TRAINING SHOE

CROSS-REFERENCE TO RELATED APPLICATIONS

Not Applicable

STATEMENT RE: FEDERALLY SPONSORED RESEARCH/DEVELOPMENT

Not Applicable

BACKGROUND

Because of the variety of possible uses of footwear, there are often competing considerations when it comes to optimizing the features of the shoe. For example, features that improve the stability of the shoe (such as rigidity) might be at odds with features that make the shoe more comfortable to the wearer (such as flexibility). Moreover, footwear that is designed for training exercises may benefit from a variety of unique features that depend on the specific exercises that are envisioned, any of which may compete with the other design considerations of the shoe. If the shoe is to be usable for climbing a rope, for example, special consideration might be given to gripping the rope as well as to protecting the material of the shoe from damage due to abrasion with the rope. If the shoe is to be usable for performing a handstand pushup against a wall, the optimal friction between the heel of the shoe and the wall may be a significant concern. Any features implemented to benefit specific training exercises in this way must be balanced with the other design considerations of the shoe.

BRIEF SUMMARY

The present disclosure contemplates footwear for overcoming the above drawbacks associated with the related art. One aspect of the embodiments of the present disclosure is a training shoe. The training shoe may comprise a bottom sole, a midsole disposed above at least a portion of the bottom sole, one or more panels attached to one or both of the midsole and the bottom sole to define an enclosure for a person's foot, and a sidewall comprising a thermoplastic polyurethane (TPU). The sidewall may be disposed on at least a portion of the midsole and at least a portion of the one or more panels so as to define part of an external surface of the training shoe. The sidewall may extend upward past a bottom of the enclosure on an outer side of the training shoe where the enclosure encloses an outer part of the person's foot. The sidewall may extend upward past the bottom of the enclosure on an inner side of the training shoe where the enclosure encloses an inner part of the person's foot. The sidewall may extend from the outer side of the training shoe to the inner side of the training shoe along a rear of the training shoe where the training shoe encloses a heel of the person's foot.

The sidewall may extend upward past the bottom of the enclosure by at least 10 mm on the outer side of the training shoe. The sidewall may extend upward past the bottom of the enclosure by at least 15 mm on the outer side of the training shoe. The sidewall may extend upward past the bottom of the enclosure by at least 10 mm on the inner side of the training shoe. The sidewall may extend upward past the bottom of the enclosure by at least 15 mm on the inner side of the training shoe. The sidewall may extend to a height above the bottom sole of at least 25 mm on the outer side of the training shoe. The sidewall may extend to a height above the bottom sole of at least 25 mm on the inner side of the training shoe. The sidewall may be grooved or ridged to promote grippiness. Along the rear of the training shoe, the sidewall may be pointed in a rearward direction.

The midsole may define part of the outer surface of the training shoe above the sidewall at the rear of the training shoe. The midsole may define part of the outer surface of the training shoe in front of the sidewall on the outer side of the training shoe and in front of the sidewall on the inner side of the training shoe. The midsole may comprise an ethylene vinyl acetate (EVA).

The one or more panels may comprise a microfiber. The sidewall may be glued to the microfiber of the one or more panels.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 10 shows a pair of training shoes being used for a rope climbing exercise;

FIG. 11 is a closeup view one of the pair of training shoes where it contacts the rope.

DETAILED DESCRIPTION

The present disclosure encompasses various embodiments of training shoes. The detailed description set forth below in connection with the appended drawings is intended as a description of several currently contemplated embodiments and is not intended to represent the only form in which the disclosed invention may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

FIGS. 1-9 are views of a training shoe 10 for a left foot. While not separately illustrated, the training shoe 10 may also be symmetrically designed for a right foot. The resulting pair of training shoes 10 may advantageously be worn during various training exercises including rope climbing (see FIGS. 10 and 11) and handstand pushups (see FIG. 12).

Figure 8:
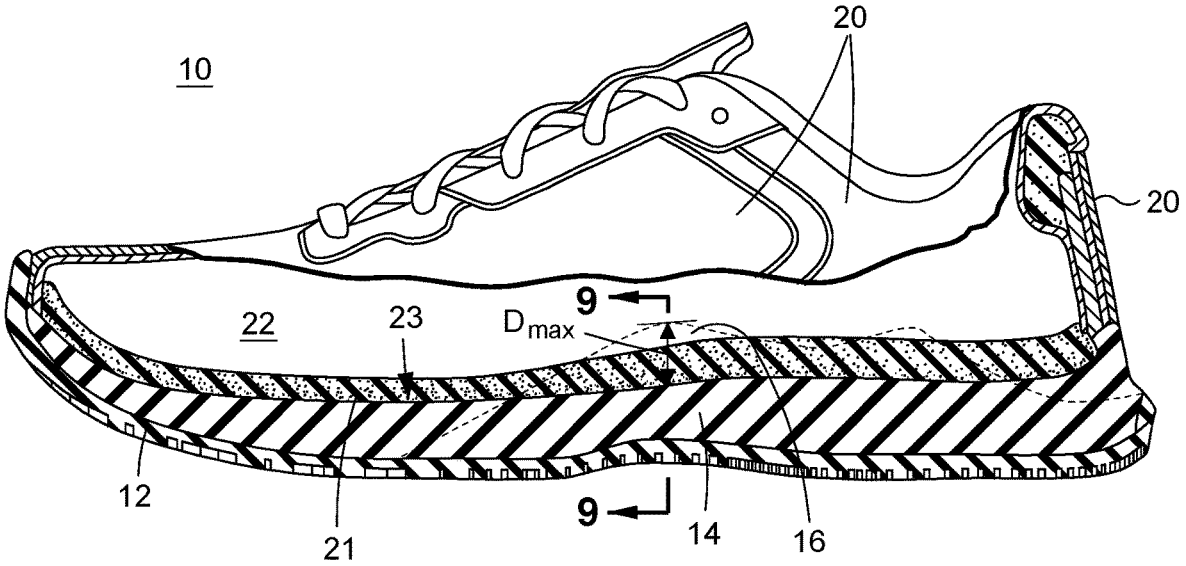
FIG. 8 is a partial cross-sectional view of the training shoe taken along the line 8-8 in FIG. 4.
Figure 9:
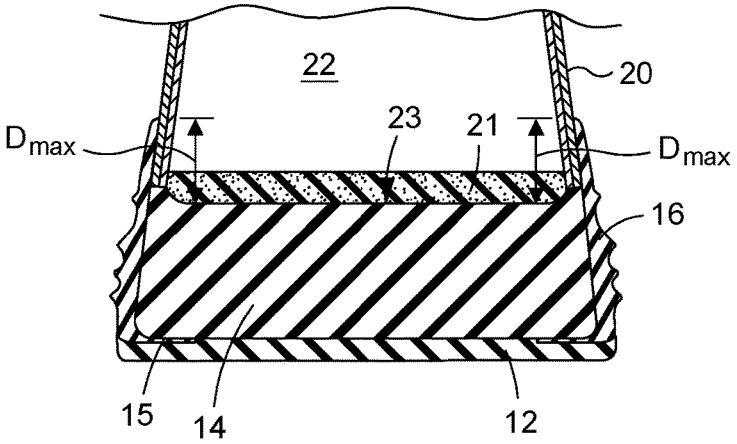
FIG. 9 is a partial cross-sectional view of the training shoe taken along the line 9-9 in FIG. 8.

The training shoe 10 may include a bottom sole 12 (which may be made of rubber such as 70 durometer rubber that is textured for traction, for example), a midsole 14 disposed above at least a portion of the bottom sole 12, and one or more panels 20, which may be attached to one or both of the midsole 14 and the bottom sole 12 to define an enclosure 22 for a person's foot (see FIGS. 8 and 9). The panel(s) 20, which may be made of microfiber, for example, may comprise an upper, vamp, quarter, etc. that surround the foot while the training shoe 10 is being worn. The midsole 14 may typically comprise an ethylene vinyl acetate (EVA) such as a 60 durometer EVA, for example, for comfort and shock absorption.

To provide additional lateral stability and support, and in particular for the benefit of the envisioned training exercises, a sidewall 16 comprising a thermoplastic polyurethane (TPU) (e.g., 70-80 durometer, preferably 75 durometer, and typically stiffer than the material of the midsole 14) may be disposed on at least a portion of the midsole 14 and at least a portion of the panel(s) 20 so as to define part of an external surface of the training shoe 10. As shown, for example, the sidewall 16 may extend upward from the bottom sole 12 to partially cover the midsole 14 in some areas and to completely cover the midsole 14 in other areas. Unlike in the case of conventional training shoes, the sidewall 16 of the training shoe 10 may extend upward above the midsole 14 in some areas to cover part of the panel(s) 20. In particular, the sidewall 16 may extend upward on the outer side of the training shoe 10 corresponding to an outer part of the person's foot (visible in FIG. 3), on the inner side of the training shoe 10 corresponding to an inner part of the person's foot (visible in FIGS. 1 and 2), or both, preferably high enough upward to provide the panel(s) 20 with protection from rope climbing abrasion and to aid in traction on one or both sides of the training shoe 10 (e.g., to help grip the rope as shown in FIGS. 10 and 11). At the same time, the sidewall 16 may extend along the rear of the training shoe corresponding to a heel of the person's foot (visible in FIGS. 1 and 4). As a result, the smooth heel area of the TPU may allow the wearer of the training shoe 10 to slide the training shoe 10 against the wall easily during handstand pushups (see FIG. 12), with minimal friction and without the stutter that is experienced with conventional shoes.

As best seen in the cross-sectional views of FIGS. 8 and 9 (which are taken along the line 8-8 in FIG. 4 and the line 9-9 in FIG. 8, respectively), the sidewall 16 may extend upward past a bottom 23 of the enclosure 22 on the outer side and/or on the inner side of the training shoe 10. In this regard, the top of the midsole 14 (on which an insole 21 may be provided as shown) may define the bottom 23 of the enclosure 22. At its highest point on each side of the training shoe 10 (i.e., on the inner side shown in FIG. 2 and on the outer side shown in FIG. 3), the sidewall 16 may extend above the bottom 23 of the enclosure 22 by a distance $D_{max}$ as depicted in FIGS. 8 and 9. For simplicity, FIG. 9 refers to the distance on both inner and outer side as $D_{max}$, but it is noted that these two distances may or may not be the same. Advantageously, the sidewall 16 may extend upward past the bottom 23 of the enclosure 22 by at least 10 mm (e.g., $D_{max} \geq 10$ mm), preferably by at least 15 mm (e.g., $D_{max} \geq 15$ mm) or even by at least 20 mm (e.g., $D_{max} \geq 20$ mm), on either or both of the inner and outer sides of the training shoe 10. In this way, the sidewall 16 may prevent damaging abrasion of the training shoe 10, and particularly of the panel(s) 20, while also providing an effective gripping surface during a rope climbing exercise as described in more detail below. Relatedly, it is contemplated that the sidewall 16 may extend to a height $H_{max}$ of at least 25 mm above the bottom sole 12, preferably at least 30 mm, on inner and/or outer sides of the training shoe 10 (see FIGS. 2 and 3), with the heights $H_{max}$ on inner and outer sides being the same or different depending on the particular design of the training shoe 10 and envisioned exercises.

Figure 1:
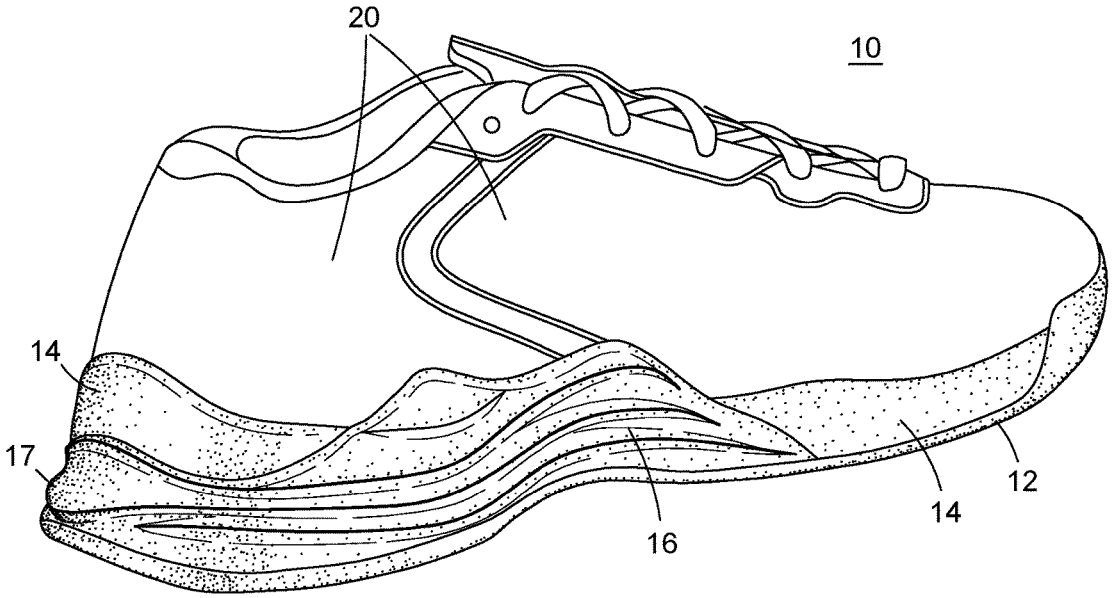
FIG. 1 is a perspective view of a training shoe for a left foot, showing a rear and an inner side thereof.
Figure 2:
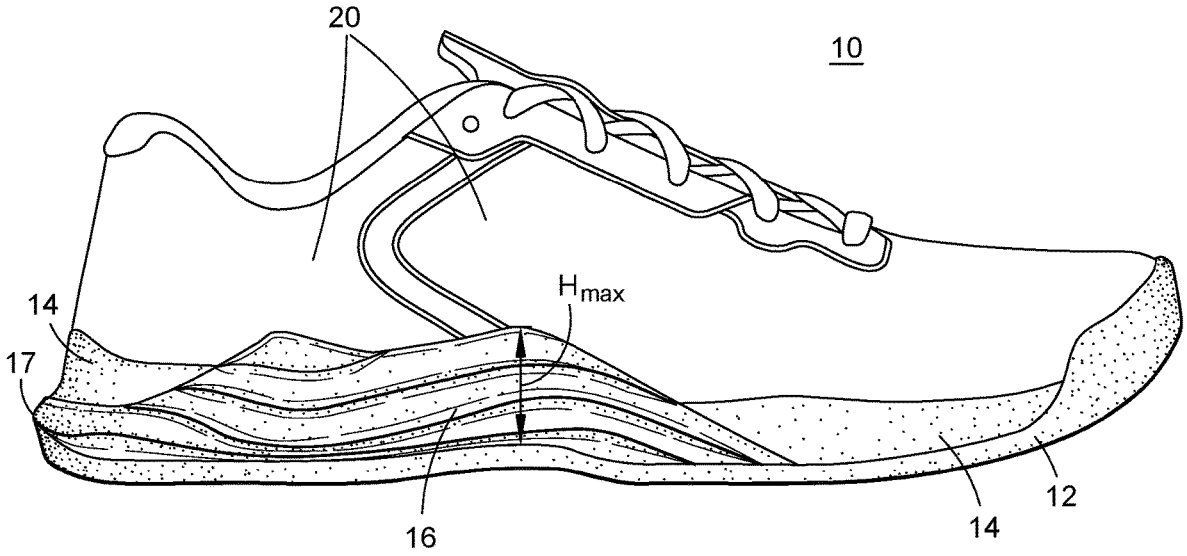
FIG. 2 is a right side view of the training shoe, showing the inner side thereof.
Figure 3:
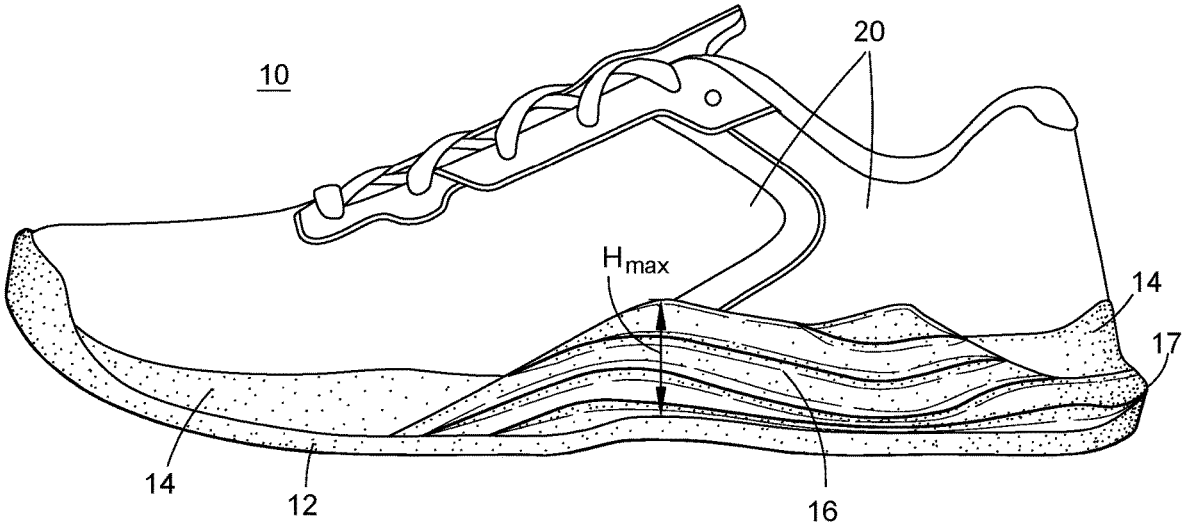
FIG. 3 is a left side view of the training shoe, showing an outer side thereof.
Figure 4:
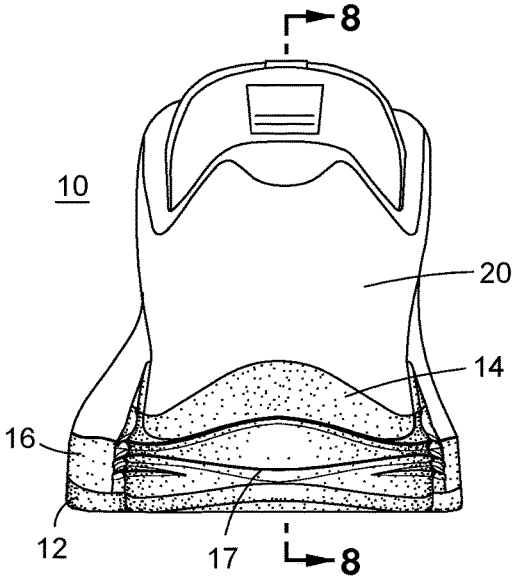
FIG. 4 is a rear view of the training shoe.
Figure 5:
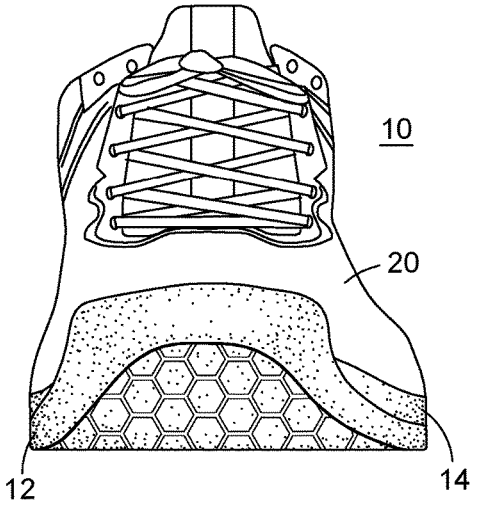
FIG. 5 is a front view of the training shoe.
Figure 6:
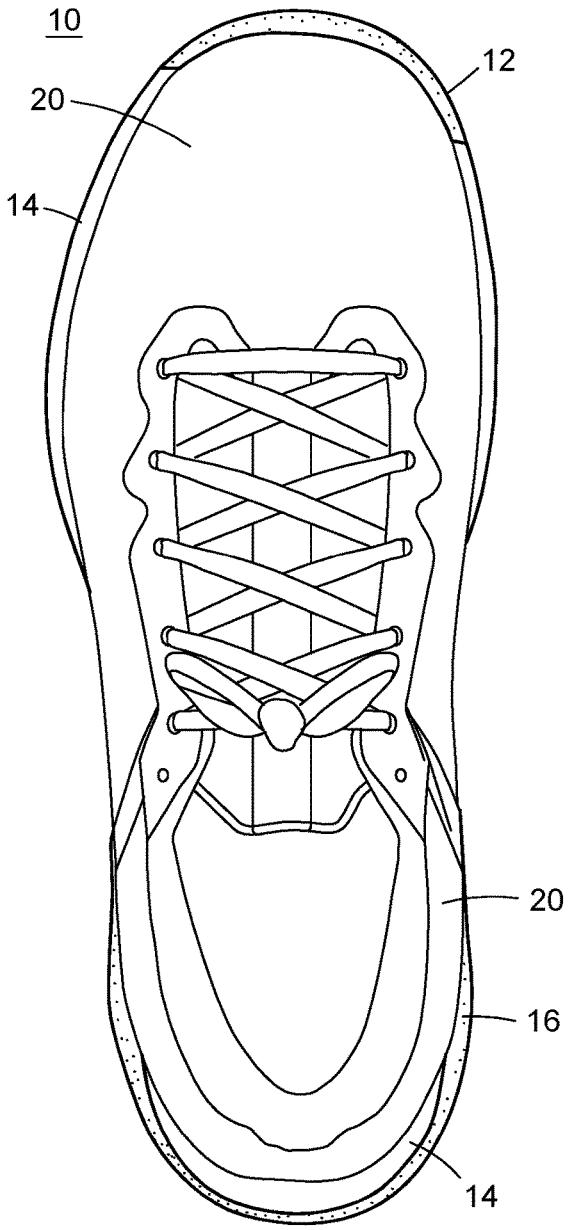
FIG. 6 is a top view of the training shoe.
Figure 7:
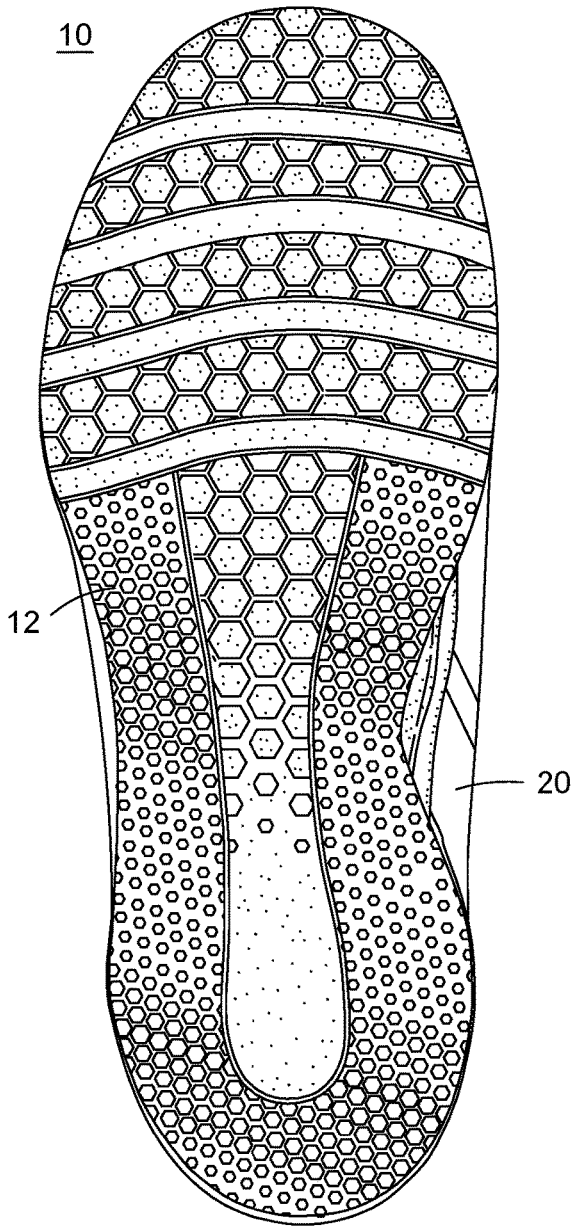
FIG. 7 is a bottom view of the training shoe.

As noted above, the sidewall 16 may extend from the outer side of the training shoe 10 to the inner side of the training shoe 10 along a rear of the training shoe 10 where the training shoe 10 encloses a heel of the person's foot (see FIGS. 1 and 4). In this regard, the sidewall 16 may be formed as a one-piece, continuous band of TPU that wraps from one side of the training shoe 10 to the other along the rear of the training shoe 10 and is adhered (e.g., glued) to the panel(s) 20 midsole 14, and/or bottom sole 12. It is contemplated that the height of the side wall 16 at the rear of the training shoe 10 may be less than on the outer/inner sides of the training shoe 10, such that the sidewall 16 may only partially cover the midsole 14 in this region. As such, the midsole 14 may define part of the outer surface of the training shoe 10 above the sidewall 16 at the rear of the training shoe 10 and may thus be partially visible in this region as best seen in FIG. 4, for example. The midsole 14 may also define part of the outer surface of the training shoe 10 in front of the sidewall 16 on the outer side of the training shoe 10 (see FIGS. 3, 5, and 6) and in front of the sidewall 16 on the inner side of the training shoe 10 (see FIGS. 1, 2, 5, and 6). In this regard, the continuous band of TPU that forms the sidewall 16 may terminate prior to reaching the front of the training shoe 10 on either side of the training shoe 10, such that the sidewall 16 wraps only around the rear of the training shoe 10 and not the front. As best seen in FIG. 9, the bottom of the sidewall 16 may have a small, inward-pointing edge 15 (e.g., 8 mm by 1 mm thick) that folds underneath the midsole 14 where the sidewall 16 abuts the bottom sole 12. The edge 15 may help to hold the sidewall 16 in place and promote better contact (e.g., for application of adhesive) between the sidewall 16 and the bottom sole 12 in order to ensure structural integrity of the training shoe 10 during manufacture and use.

FIGS. 10 and 11 show a pair of training shoes 10 (left and right) being used for a rope climbing exercise, with FIG. 11 being a closeup view of one of the training shoes 10 where it contacts the rope 30. As depicted, the athlete wearing the training shoes 10 may wrap the rope 30 under and around one foot and position the other foot on or tightly beside the wrapped foot to keep the rope 30 in place. Using leg power, the athlete may then propel upward and repeat the steps until tapping a ceiling target or otherwise completing the exercise. During these motions, the TPU sidewall 16 may protect the sides of the training shoe 10 by reducing abrasion on the fabric of the panel(s) 20. At the same time, the three-dimensional shape of the sidewall 16 may create grippiness to aid in rope climbing and reduce slippage. In this respect, as best seen in FIG. 11, the sidewall 16 may be grooved (see grooves 18) or ridged (see ridges 19) to promote grippiness and prevent the rope 30 from easily sliding along the sidewall 16.

Figure 12:
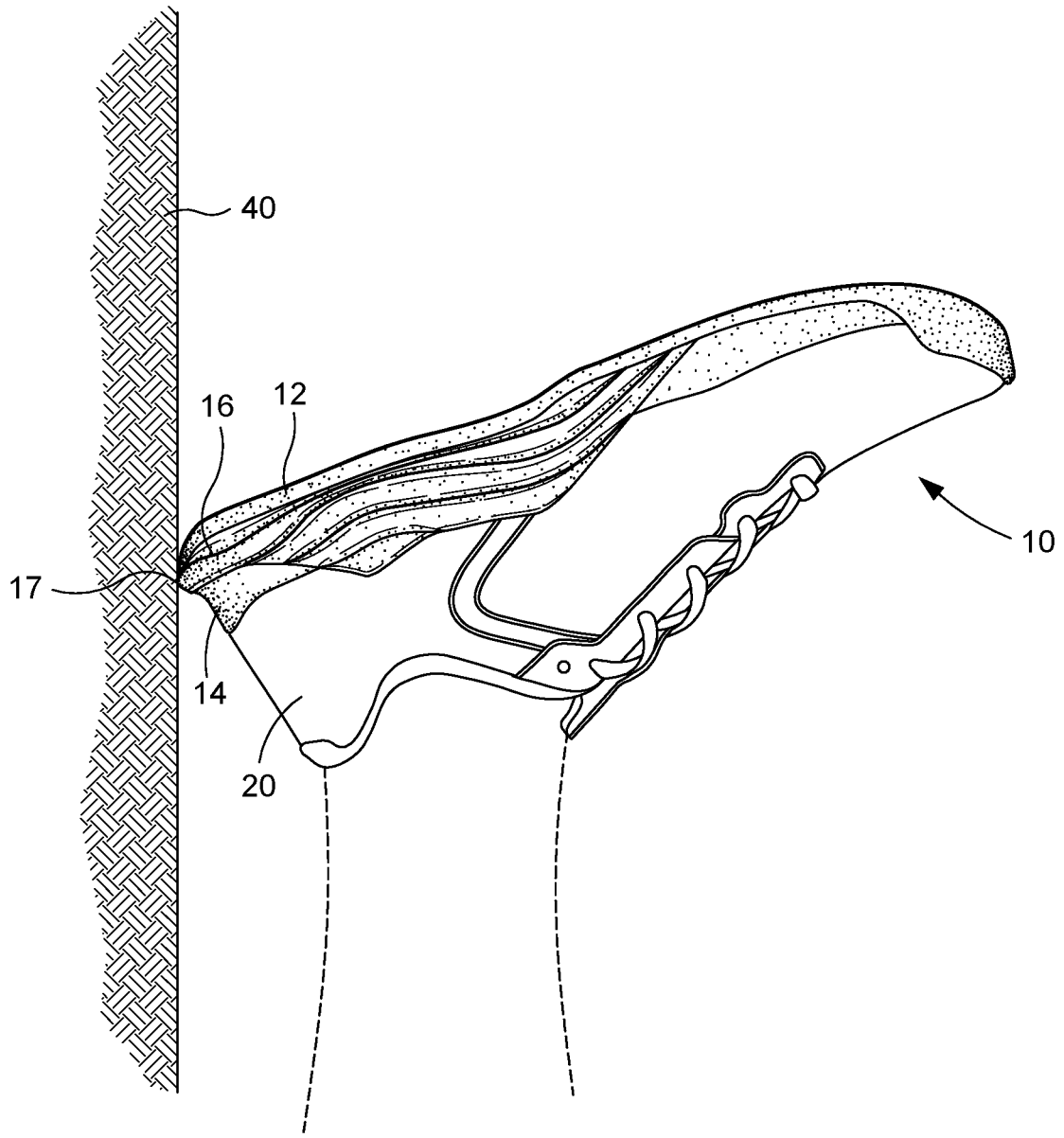
FIG. 12 shows the training shoe being used for a handstand pushup exercise.

FIG. 12 shows the training shoe 10 being used for a handstand pushup exercise. Here, the athlete wearing the training shoes 10 may position his/herself upside down and do pushups against a wall 40. As the athlete's arms lift his/her body up and down, the heel of the training shoe 10 drags along the wall 40. Owing to the smoothness of the TPU (due to its relative hardness as compared to the other materials of the training shoe 10), the sidewall 16 slides against the wall 40 easily with minimal friction and without stutter that would typically result from dragging the rubber bottom sole 12 against the wall 12. Preferably, the sidewall 16 may be pointed in the rearward direction along the rear of the training shoe 10 so as to exhibit a protrusion 17 that extends past the bottom sole 12 as illustrated (see FIGS. 1-3 in addition to FIG. 12). In this way, it can be assured that the TPU sidewall 16, rather than the bottom sole 12, will contact the wall 40 so that the athlete can benefit from the smoothness of the TPU sidewall 16 against the wall 40.

Owing to the various features of the embodiments described herein, the training shoe 10 may be balanced for comfort in the midsole 14 and upper fabric of the panel(s) 20 and stability in the flat bottom sole 12, in the lateral support from the sidewall 16, and throughout reinforcement in the upper. An 8-10 mm (e.g., 9 mm) midsole drop may bridge the gap between stiff, clunky training shoes and flexible, fast running shoes. Articulation of the forefoot in the bottom sole 12 may allow for improved movement and performance. In addition to improving stability and support, the TPU sidewall 16 may provide protection of the upper fabric from rope climbing abrasion and aid in traction during various training exercises as described above.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A training shoe comprising:

a bottom sole;

a midsole disposed above at least a portion of the bottom sole;

one or more panels attached to one or both of the midsole and the bottom sole to define an enclosure for a person's foot; and a sidewall comprising a thermoplastic polyurethane (TPU), the sidewall disposed on at least a portion of the midsole and at least a portion of the one or more panels so as to define part of an external surface of the training shoe, the sidewall extending from an outer side of the training shoe where the enclosure is configured to enclose an outer part of the person's foot along a rear of the training shoe where the training shoe is configured to enclose a heel of the person's foot to an inner side of the training shoe where the enclosure is configured to enclose an inner part of the person's foot, the sidewall extending upward from a bottom of the midsole past a bottom of the enclosure high enough to provide the one or more panels with protection from abrasion with a rope during rope climbing on the outer side of the training shoe at a position in front of the rear of the training shoe and on the inner side of the training shoe at a position in front of the rear of the training shoe, the sidewall having a three-dimensional shape including a plurality of grooves and ridges to promote grippiness of the sidewall to the rope, wherein, along the rear of the training shoe, the sidewall is pointed in a rearward direction so as to exhibit a protrusion made of TPU that extends past the bottom sole.

2. The training shoe of claim 1, wherein the sidewall extends upward past the bottom of the enclosure by at least 10 mm on the outer side of the training shoe.

3. The training shoe of claim 2, wherein the sidewall extends upward past the bottom of the enclosure by at least 15 mm on the outer side of the training shoe.

4. The training shoe of claim 1, wherein the sidewall extends upward past the bottom of the enclosure by at least 10 mm on the inner side of the training shoe.

5. The training shoe of claim 4, wherein the sidewall extends upward past the bottom of the enclosure by at least 15 mm on the inner side of the training shoe.

6. The training shoe of claim 1, wherein the sidewall extends to a height above the bottom sole of at least 25 mm on the outer side of the training shoe.

7. The training shoe of claim 1, wherein the sidewall extends to a height above the bottom sole of at least 25 mm on the inner side of the training shoe.

8. The training shoe of claim 1, wherein the midsole defines part of the external surface of the training shoe above the sidewall at the rear of the training shoe.

9. The training shoe of claim 1, wherein the midsole defines part of the external surface of the training shoe in front of the sidewall on the outer side of the training shoe and in front of the sidewall on the inner side of the training shoe.

10. The training shoe of claim 1, wherein the midsole comprises an ethylene vinyl acetate (EVA).

11. The training shoe of claim 1, wherein the one or more panels comprises a microfiber.

12. The training shoe of claim 1, wherein the sidewall extends upward past the bottom of the enclosure by at least 20 millimeters on either or both of the outer side and the inner side of the training shoe.

13. A training shoe comprising:

a bottom sole;

a midsole disposed above at least a portion of the bottom sole;

one or more panels attached to one or both of the midsole and the bottom sole to define an enclosure for a person's foot; and a sidewall comprising a thermoplastic polyurethane (TPU), the sidewall disposed on at least a portion of the midsole and at least a portion of the one or more panels so as to define part of an external surface of the training shoe, the sidewall extending from an outer side of the training shoe where the enclosure is configured to enclose an outer part of the person's foot along a rear of the training shoe where the training shoe is configured to enclose a heel of the person's foot to an inner side of the training shoe where the enclosure is configured to enclose an inner part of the person's foot, the sidewall extending upward from a bottom of the midsole past a bottom of the enclosure high enough to provide the one or more panels with protection from abrasion with a rope during rope climbing on either or both of the outer side of the training shoe at a position in front of the rear of the training shoe and the inner side of the training shoe at a position in front of the rear of the training shoe, the sidewall having a three-dimensional shape including a plurality of grooves and ridges to promote grippiness of the sidewall to the rope, wherein, along the rear of the training shoe, the sidewall is pointed in a rearward direction so as to exhibit a protrusion made of TPU that extends past the bottom sole.

14. The training shoe of claim 13, wherein the sidewall extends upward past the bottom of the enclosure by at least 10 mm on either or both of the outer side of the training shoe and the inner side of the training shoe.

15. The training shoe of claim 14, wherein the sidewall extends upward past the bottom of the enclosure by at least 15 mm on either or both of the outer side of the training shoe and the inner side of the training shoe.

16. The training shoe of claim 13, wherein the sidewall extends upward past the bottom of the enclosure by at least 20 millimeters on either or both of the outer side and the inner side of the training shoe.

17. A training shoe comprising:

a bottom sole;

a midsole disposed above at least a portion of the bottom sole;

one or more panels attached to one or both of the midsole and the bottom sole to define an enclosure for a person's foot; and a sidewall comprising a thermoplastic polyurethane (TPU), the sidewall disposed on at least a portion of the midsole and at least a portion of the one or more panels so as to define part of an external surface of the training shoe, the sidewall extending from an outer side of the training shoe where the enclosure is configured to enclose an outer part of the person's foot along a rear of the training shoe where the training shoe is configured to enclose a heel of the person's foot to an inner side of the training shoe where the enclosure is configured to enclose an inner part of the person's foot, a maximum height above the bottom sole of the sidewall at the rear of the training shoe being less than a maximum height above the bottom sole of the sidewall at the outer side of the training shoe and less than a maximum height above the bottom sole of the sidewall at the inner side of the training shoe, wherein the sidewall extends upward past a bottom of the enclosure by at least 20 millimeters on either or both of the outer side and the inner side of the training shoe, wherein, along the rear of the training shoe, the sidewall is pointed in a rearward direction so as to exhibit a protrusion made of TPU that extends past the bottom sole.

* * * * *